United States Patent [19]

Brisco

[11] Patent Number: 4,662,453

[45] Date of Patent: May 5, 1987

[54] LINER SCREEN TIEBACK PACKER APPARATUS AND METHOD

[75] Inventor: David P. Brisco, Duncan, Okla.

[73] Assignee: Halliburton Company, Duncan, Okla.

[21] Appl. No.: 824,021

[22] Filed: Jan. 29, 1986

[51] Int. Cl.[4] ..... E21B 33/12

[52] U.S. Cl. ..... 166/387; 166/136

[58] Field of Search ..... 166/136, 137, 139, 387

[56] References Cited

U.S. PATENT DOCUMENTS

| | | | |
|---|---|---|---|
| 2,976,076 | 3/1961 | Farley | 294/102 |
| 3,232,347 | 2/1966 | Thrane | 166/136 |
| 3,409,085 | 11/1968 | Oliver | 166/134 |
| 3,584,684 | 6/1971 | Anderson et al. | 166/129 |
| 4,332,410 | 6/1982 | Baker | 294/86.18 |
| 4,427,063 | 1/1984 | Skinner | 166/139 X |

OTHER PUBLICATIONS

Halliburton Services Catalog No. 41, pp. 4027 and 4028.
Halliburton Tools Manual, pp. 2–43, 2–51 and 2–52.

*Primary Examiner*—Stephen J. Novosad
*Assistant Examiner*—Thomas J. Odar
*Attorney, Agent, or Firm*—Joseph A. Walkowski; Neal R. Kennedy

[57] ABSTRACT

A tieback packer apparatus and method for packing a well annulus above a gravel packed liner screen. The packer includes a body with a mandrel slidingly disposed therein. Originally, the mandrel is shearably pinned to the body. The body includes a lower packer support for a packer element annularly disposed around the mandrel. An upper packer support is also shearably pinned to the mandrel and includes a wedge. A plurality of slips are positioned above the wedge. Downward motion of the mandrel shears the shear pins and transfers force through a spring, thus forcing the slips toward the wedge and outwardly into gripping engagement with the well bore. The spring keeps the slips engaged while preventing excessive slip drag. Further downward movement of the mandrel sets the packer element into sealing engagement with the well bore. The packer may be retrieved by reengaging the releasing mechanism. Lifting sequentially unsets the slips, as well as unsetting the packer element.

10 Claims, 6 Drawing Figures

LINER SCREEN TIEBACK PACKER APPARATUS AND METHOD

BACKGROUND OF THE INVENTION

1. Field Of The Invention

This invention relates to retrievable packers for use on top of gravel packed screen liners and methods of use thereof, and more particularly, to a packer attachable to a liner screen and a method which eliminates excessive slip drag during setting of a packer element thereof and which utilizes pressure from below the packer to further engage the slips.

2. Description Of The Prior Art

Use of packers above gravel packed liner screens is known in the art. Typically, the liner screen is at the bottom of a tool string, releasbly disposed at a point below a gravel packer. After the gravel packing operation, the gravel packer is unset, and the tool string is detached from the liner screen. The gravel pack keeps the liner screen positioned while the tool string is removed from a well. A packer, frequently referred to as a tieback packer, is run into the well bore and set above the liner screen in the gravel pack. The tieback packer is then released from the tool string, and the tool string again removed from the hole.

Many such packers utilize slips to hold the packer in position when the packer element is sealingly engaged with the well bore. However, a problem with current packers is that the slips are dragged along the well bore during the setting process. The result is that the slips are difficult or impossible to disengage from the well bore when it is desired to retrieve the packer. In such cases, the packer may have to be milled over, an expensive and time-consuming process.

The tieback packer of the present invention solves these problems in that it eliminates excessive slip drag by the slips on the well bore during setting by using a spring for preventing downward motion of the tool string from exerting excessive force on the slips. After the packer element is set, pressure from below the packer forces a wedge portion thereof under the slips, setting them tighter. In this way, the slips are securely set without excessive drag.

A bridge plug having a force limiting spring is shown in Halliburton Services Catalog No. 41, pages 4027 and 4028, and Halliburton Tools Manual, pages 2–43, 2–51 and 2–52. A production packer utilizing a spring for engaging slips is disclosed in U. S. Pat. No. 3,584,684 to Anderson et al., and assigned to the assignee of the present application. Unlike the tieback packer of the present invention, these prior apparatus require rotation during a setting operation.

No rotation is necessary for setting the slips or packer element in the present invention. Simple longitudinal movement of the tool string is used to set and release the slips and packer element.

SUMMARY OF THE INVENTION

The apparatus of the present invention is a tieback packer for use in sealing above a rigidly located tool, such as gravel packed liner screen in a well bore. The apparatus comprises packer means for sealingly engaging the well bore when in a packer means set position, body means attached to the packer means for engaging the liner screen and for limiting downward movement of the packer means, the body means defining a central opening therethrough. The apparatus further comprises slip means adjacent the packer means, mandrel means slidingly disposed in the body means central opening, and biasing means engaged with the slip means and the mandrel means.

Longitudinally downward movement of the mandrel means actuates the packer means to the packer means set position and transmits the downward force through the biasing means to the slip means, thereby actuating the slip means to the slip means set position. The biasing means also limits the force transmitted from the mandrel means to the slip means, thus eliminating undesired drag of the slip means on the well bore. The biasing means preferably comprises a helically coiled spring.

Longitudinally upward movement of the mandrel means reverses the process and unsets the slip means and the packer means from engagement with the well bore. Because excessive drag of the slip means has been eliminated, the slip means are easier to disengage from the well bore and therefore less force is required.

In the preferred embodiment, the slip means comprises a plurality of slip elements, each of the slip elements being in gripping engagement with the well bore when the slip means is in a set position.

The slip means also comprises a slip retainer responsive to upward movement of the mandrel means, and the slip retainer has a lower edge with a plurality of circumferentially spaced slots therein. The slots are sequentially spaced from the lower edge of the slip retainer.

Preferably, the apparatus further comprises sequential slip release means characterized by a lowermost portion of each of the slots. Each of the slip elements comprises a flange portion disposed in a corresponding slot, and as the slip retainer is upwardly moved by the mandrel means, the lowermost portions of the slots sequentially engage and upwardly move the corresponding slip elements, thus disengaging the slip elements from the well bore.

Rotation prevention means are provided for preventing relative rotation of the mandrel means with respect to the slip means during both the setting and unsetting operations.

The apparatus also includes shear mean sfor shearably attaching the packing means to the mandrel means and which are sheared during the setting operation.

Sealing means are included between the mandrel means and body means for preventing fluid communication between the body means central opening and a well annulus adjacent a lower end of the packer means and below the set packer means. Port means act to equalize pressure between the sealing means and the well annulus.

Retrievable releasing means are used to releasably attach the apparatus to a tool string. After engagement of the body means with the liner screen, the tieback packer may be released from the tool string. When desired, the retrievable releasing means may be used for reengaging the packer to the tool string.

The tieback packer apparatus may be used in a method of packing a well annulus above a gravel packed liner screen in a well bore comprising the steps of attaching the packer to the tool string, positioning the tool string and the packer in the well bore such that the packer is in sealing engagement with the liner screen and downward movement of the packer is limited by the liner screen when so engaged, setting slip means on the packer for limiting upward movement of the packer, setting a packer element on the packer for sealing the well bore of the liner screen, while preventing excessive drag of the slip means on the well bore, and releasing the packer from the tool string. If pressure increases below the packer, the slips will be set tighter.

The steps of setting the slip means and packer means comprise longitudinally downwardly moving a mandrel in the packer and preventing rotation of the mandrel with respect to the slip means and packer element.

Retrieval of the packer from the well comprises the steps of reengaging the tool string with the packer, unsetting the packer element, unsetting the slip means, disengaging the packer from the liner screen, and removing the tool string and packer attached thereto from the well bore.

The steps of unsetting the packer element and slip means comprise longitudinally upwardly moving the mandrel, also preventing rotation thereof with respect to the slip means packer element.

The step of unsetting the slip means preferably comprises sequentially disengaging a plurality of seal elements from engagement with the well bore.

An important object of the present invention is to prevent migration of gravel pack sand around the top of a liner screen.

Another object of the present invention is to provide a liner screen tieback packer which is rigidly located in a well bore by a liner screen therebelow and slips thereon.

A further object of the invention is to provide a retrievable tieback packer for sealing of a liner screen.

An additional object of the present invention is to provide a packer in which upward movement thereof is limited by a set of slips and excessive drag of the slips during setting thereof is prevented.

Still another object of the present invention is to provide a method of packing a well annulus above a liner screen with a retrievable packer.

Additional objects and advantages of the invention will become apparent as the following detailed description of the preferred embodiment is read in conjunction with the accompanying drawings which illustrate such preferred embodiment.

DESCRIPTION OF THE PREFERRED EMBODIMENT

Figure 1A:
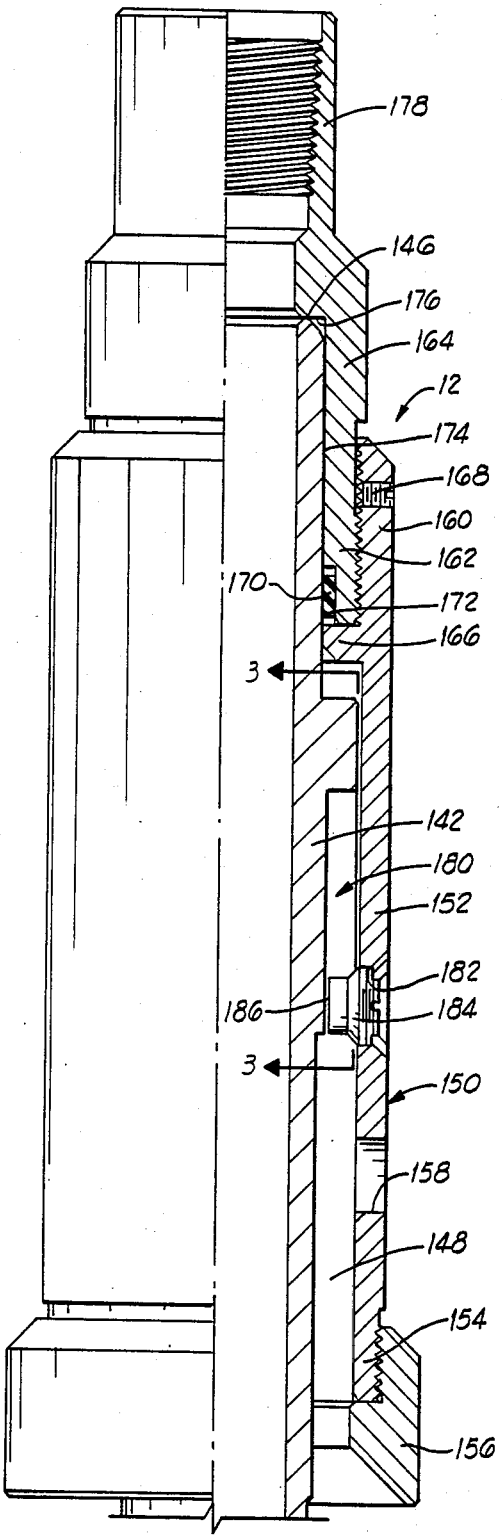
FIGS. 1A–1D illustrate a partial cross section and partial elevation of the screen liner tieback packer of the present invention and a release mechanism attached thereto.

Referring now to the drawings, and particularly FIGS. 1A–1D, the screen liner tieback packer assembly of the present invention is shown and generally designated by the numeral 10. Packer 10 is lowered into a well bore and released therein by a releasing mechanism 12 attached to a tool string.

Figure 1B:
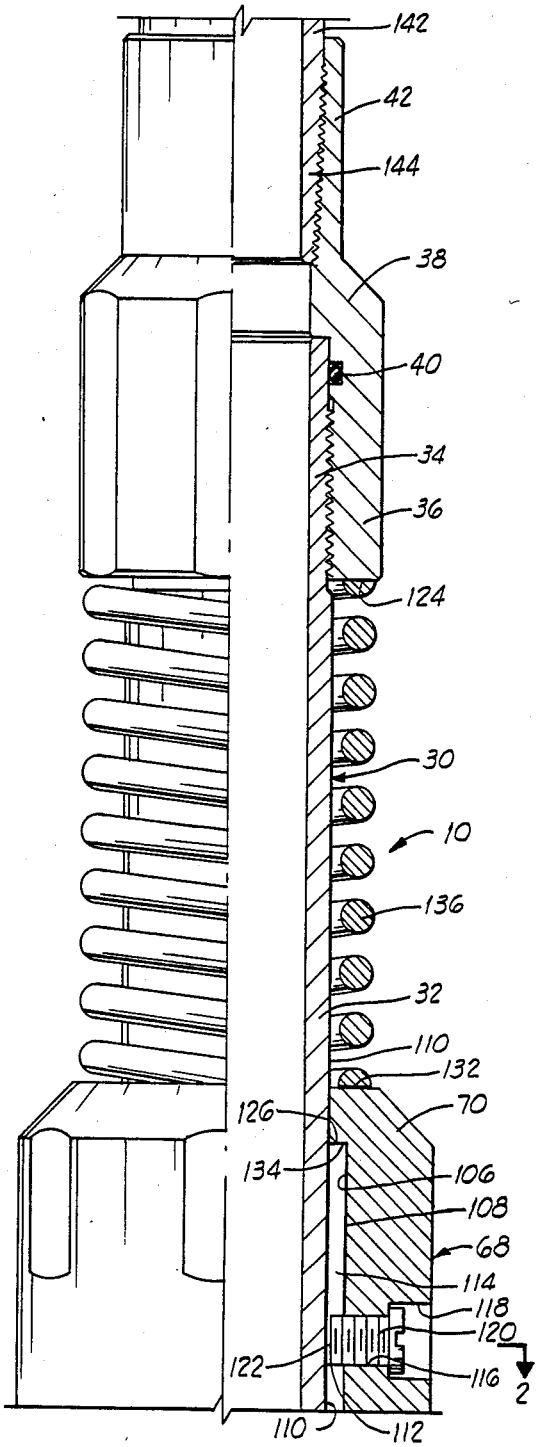
Figure 1:
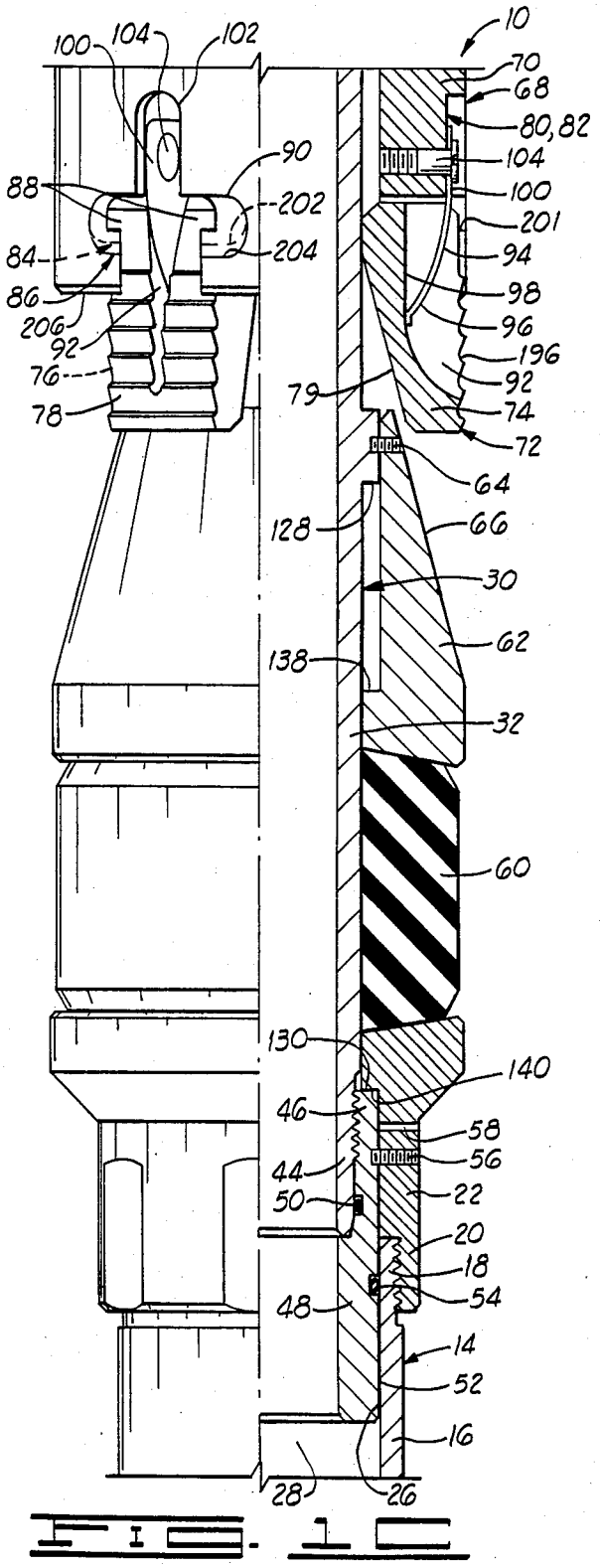
Figure 1:
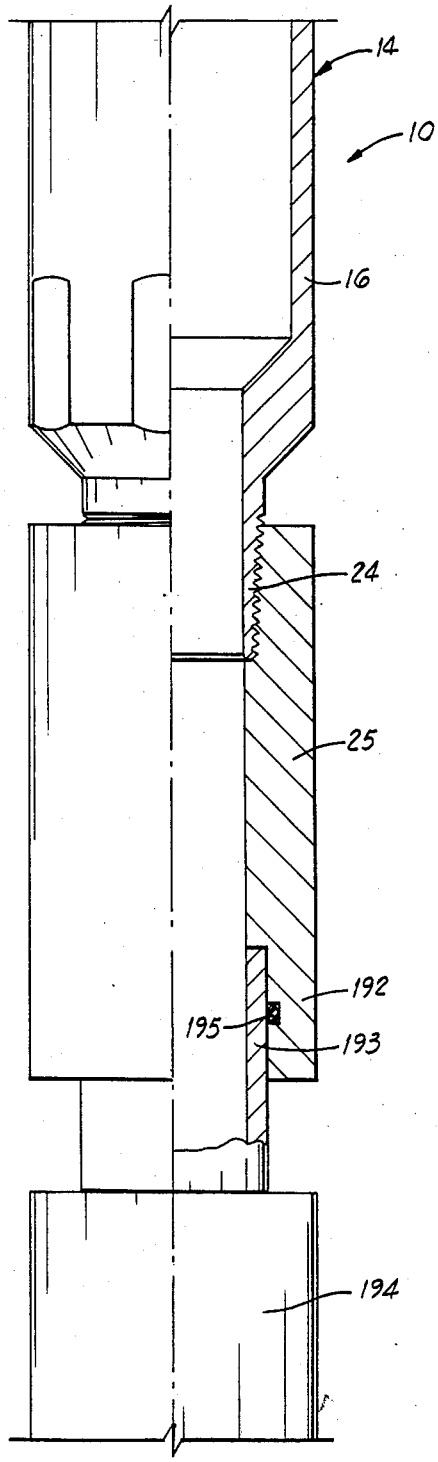

As shown in FIGS. 1B–1D, packer 10 includes body means in the form of a body portion 14 formed by a nipple 16 having a threaded upper end 18 threadingly engaged with a threaded lower end 20 of a packer shoe 22. Nipple 16 has a threaded lower end 24 adapted for attachment to a sealing nipple 25. Body 14 has an internal surface 26 which defines a portion of a central opening 28 through the body.

Slidably disposed with respect to body 14 is a mandrel portion 30 formed by a mandrel sleeve 32 having an upper end 34 threadingly engaged with a lower end 36 of a mandrel coupling 38. A seal, such as O-ring 40, forms a seal between coupling 38 and sleeve mandrel 32. Sleeve mandrel 38 also has a threaded upper end 42.

Mandrel sleeve 32 has a lower end 44 threadingly engaged with an upper end 46 of a mandrel shoe 48. A seal, such as O-ring 50, is disposed between mandrel sleeve 32 and mandrel shoe 48. Mandrel shoe 48 has an outside surface 52 dimensioned to closely, but slidingly, fit within internal surface 26 of body 14. An O-ring 54 provides a seal between mandrel 30 and body 14. Thus mandrel means are provided which slide with respect to the body means.

A shear pin 56 provides shear means for holding mandrel 30 in position with respect to body 14 as packer 10 is run into the well bore. Port means in the form of a hole 58 provides fluid communication between mandrel 30 above O-ring 54 and a well annulus adjacent and below packer shoe 22.

Packer shoe 22 provides a lower packer support for a packer element 60 annularly disposed around mandrel 30. An upper packer support 62 is disposed above packer element 60 and is shearably attached to mandrel 30 by shear means such as a shear pin 64. Packer shoe 22, upper packer support 62 and packer element 60 characterize packer means for sealingly engaging the well bore. It will be seen that upper packer support 62 includes a wedge 66.

Positioned adjacent and above upper packer support 62 are slip means comprising a slip assembly 68 which includes a slip retainer 70 and a plurality of slips 72. In the preferred embodiment, three slips 74, 76 and 78 are used. Slip 76 is actually not visible in FIG. 1C, but is indicated by a phantom reference line. Slip 76 is angularly positioned about a vertical center line from slip 74 at an angle equal to that at which slip 78 is angularly positioned from slip 74. Each slip has a tapered inner surface 79 adjacent wedge 66.

Slip retainer 70 has a plurality of circumferentially spaced inverted, substantially T-shaped slots disposed therethrough. In the preferred embodiment, three such slots 82, 84, and 86 are used corresponding to slips 74, 76 and 78, respectively. Each of slips 74, 76 and 78 are a T-shaped upper end with a pair of oppositely extending transverse flanges 88. Flanges 88 are engaged with a substantially horizontal portion 90 of slots 82, 84 and 86.

Each of slips 74, 76 and 78 defines a deep outwardly opening groove 92 therein. A slip retaining spring 94, in the form of a leaf spring, has a lower end 96 which springingly engages an innermost surface 98 of each groove 92. An upper end 100 of each spring 94 extends into vertical portion 102 of each of slots 82, 84 and 86 in slip retainer 70. Upper end 100 of each spring 94 is fixedly attached to slip retainer 70 by a bolt 104. Springs 94 thus provide biasing means for biasing slips 72 away from the well bore.

Figure 2:
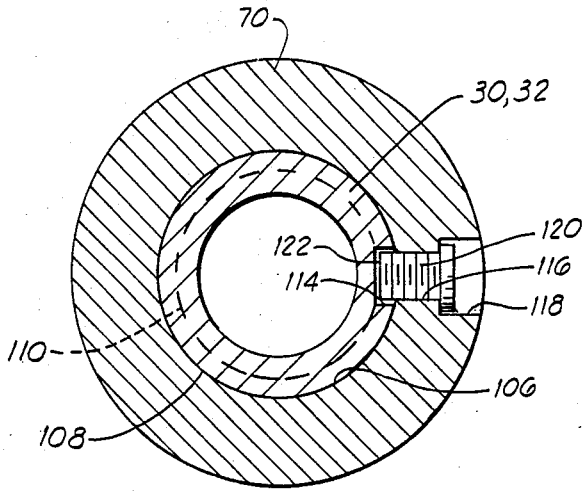
FIG. 2 is a transverse cross section taken along lines 2—2 in FIG. 1B.

Referring now to FIGS. 1B and 2, slip retainer 70 has an inner surface 106 which is in close relationship to an enlarged portion 108 of mandrel sleeve 32. It will be seen that outer portion 108 of mandrel sleeve 32 extends outwardly from outer surface 110 thereof. Enlarged portion 108 has a lower end 112.

Enlarged portion 108 defines a longitudinally extending slot 114 therealong. Facing slot 114 is a threaded opening 116 extending through slip retainer 70 and having a countersunk portion 118. A pin 120 is threadingly engaged with opening 116 and has an inner end 122 which extends into slot 114, thus acting as a rotation prevention means for preventing rotation of mandrel 30 with respect to slip retainer 70.

A study of FIGS. 1B and 1C will show that mandrel portion 30 includes a first, downwardly facing shoulder 124, a second, upwardly facing shoulder 126 forming an upper end of enlarged portion 108 of mandrel sleeve 32, a third, downwardly facing shoulder 128, and a fourth, upwardly facing shoulder 130 thereon.

It will be seen that slip retainer 70 has a first, upwardly facing shoulder thereon opposite first shoulder 124 of mandrel 30. Slip retainer 70 also includes a second, downwardly facing shoulder 134. Biasing means, preferably such as a longitudinally disposed, helically coiled spring 136 is placed between first shoulder 124 of mandrel 30 and first shoulder 132 of slip retainer 70 to bias the shoulders apart. In the run-in configuration shown in FIGS. 1A-1D, spring 136 forces second shoulder 134 of slip retainer 70 into contact with second shoulder 126 of mandrel 30. In this position, slips 72 and packer element 60 are in unset positions.

Upper packer support 62 has an upwardly facing shoulder 138 thereon which faces third shoulder 128 of mandrel 30 and is downwardly spaced therefrom, as best shown in FIG. 1C. Packer shoe 22 has a downwardly facing shoulder 140 thereon which is adapted to be in contact with fourth shoulder 130 of mandrel 30 when packer shoe 22 and upper packer support 62 are pinned to the mandrel by shear pins 56 and 64, respectively.

Packer 10 is run into the well bore by retrievable releasing means characterized by a release mechanism 12, best shown in FIGS. 1A and 1B. Release mechanism 12 includes an inner mandrel 142 having a lower end 144 threadingly engaged with upper end 42 of coupling 38 of packer assembly 10. Inner mandrel 142 also has an upwardly facing surface 146.

Inner mandrel 142 is disposed within central opening 148 of an overshot assembly 150. Overshot 150 includes a body 152 having a lower end 154 threadingly engaged with an overshot shoe 156. Overshot shoe 156 is approximately the same diameter as slip retainer 70 and serves to guide overshot 150 as the overshot is lowered into the well bore.

A hole 158 is disposed through body 152. Hole 158 acts as a bypass means for providing a fluid bypass around overshot shoe 156 when running screen liner tieback packer assembly 10 into the well, thus preventing swabbing or pushing a column of fluid in front of assembly 10 which could result in formation damage.

Body 152 has a threaded upper end 160 engaged with a lower end 162 of an adapter 164. An inwardly directed shoulder portion 166 provides a firm lower support for adapter 164. A set screw 168 assures that no relative rotation between body 152 and adapter 164 can occur. A sealing ring 170 disposed in a seal groove 172 in adapter 164 provides continuous sealing on outer surface 174 of inner mandrel 142. Adapter 164 also includes a downwardly facing shoulder 176 which contacts upper surface 146 of inner mandrel 142. An upper end 178 of adapter 164 is adapted for threading engagement with a tool string portion above packer assembly 10 and release mechanism 12.

OPERATION OF THE APPARATUS

Figure 3:
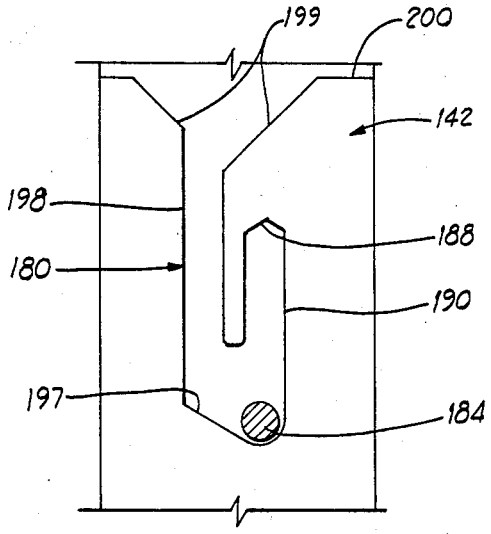
FIG. 3 is a cross section illustrating the J-slot in the retrieving mechanism and is taken along lines 3—3 in FIG. 1A.

Referring now to FIGS. 1A and 3, overshot 152 is engaged with inner mandrel 142 by J-slot means. Inner mandrel 142 defines a J-slot 180 on an outer surface thereof. Overshot 152 has a threaded opening 182 therein in which is engaged a pin 184 having an end 186 extending into J-slot 180. As release mechanism 12 is run into the well bore, pin 184 is engaged with upper surface 188 of short, substantially vertical portion 190 of J-slot 180. Packer assembly 10 is thus supported by inner mandrel 142 of release mechanism 12.

After the entire string is lowered into the well bore, lower end 192 of sealing sleeve 25 below body 14 of packer assembly 10 may be engaged with upper end 193 of liner screen 194, as shown in FIG. 1D, already present and gravel packed in the well bore. A sealing ring 195, typically on O-ring, provides sealing between sealing nipple 25 and liner screen 194.

To actuate and set slips 72 and set packer element 60 of packer assembly 10, only longitudinally downward movement of mandrel 30 is required. This is accomplished by setting down weight from the tool string onto overshot 152 which brings shoulder 176 into engagement with upper surface 146 of inner mandrel 142, as shown in FIG. 1A. Thus, additional downward movement of the tool string results in downward movement of mandrel 30. This downward motion of mandrel 30 shears shear pins 56 and 64 because body 14 is longitudinally fixed by liner screen 194 with which body 14 is engaged. The weight necessary to do this is appoximately 10,000 pounds for an apparatus designed for a seven-inch well bore.

Downward motion of mandrel 30 transmits downward motion to slip retainer 70 through spring 136. As slip retainer 70 is moved downwardly, tapered surfaces 79 of slips 72 are brought into contact with wedge 66 of upper packer support 62. Thus, slips 72 are outwardly directed from mandrel 30 such that gripping surface 196 of the slips lockingly and grippingly engages the well bore, overcoming the force exerted by slip retaining springs 94. Once slips 72 contact the well bore, second shoulder 126 of mandrel 30 moves away from shoulder 134 of slip retainer 70.

Eventually, third shoulder 128 of mandrel 30 engages shoulder 138 of upper packer support 62. Further downward movement of mandrel 30 forces upper packer support 62 closer to packer shoe 22. In this way, tool string weight is transferred directly to packer element 60 to deform it so that it expands outwardly to sealingly engage the well bore. During this setting of packer element 60, spring 136 keeps gripping surfaces 196 of slips 72 against the well bore. However, spring 136 acts as a force limiting means, insuring that the tool string weight is not transferred directly to slip retainer 70 or slip 72, thus preventing the excessive slip drag on the well bore that would be present if the tubing weight necessary to set the packer element 60 were transferred directly through slips 72.

During the downward movement of mandrel 30, shoulder 130 thereof moves away from shoulder 140 in packer shoe 22. This movement uncovers hole 58 so that the pressure between packer shoe 22 and mandrel 30 above shoulder 130 and below shoulder 140 is equalized with the pressure in the well annulus below packer element 60 and adjacent body 14. Seal 54 provides a sealing means for preventing fluid communication from inside packer assembly 10 with this annulus.

After packer element 60 of packer assembly 10 is set, 66 is always engaged with tapered surface 79 of the slips. If pressure increases below packer element 60, this pressure will force upper packer support 62 further beneath slips 72, setting the slips even tighter. Any such upward movement of upper packer support 62 will be very slight and not sufficient to unset packer element 60 which remains still in sealing engagement with the well bore.

The tool string and overshot 152 may be detached from packer 10 by right-hand rotation of overshot 152. When tool string weight is set down, it will be clear to those skilled in the art that pin 184 moves downwardly in short portion 190 of J-slot 180. Right-hand rotation of the tool string and overshot 152 causes pin 184 to engage tapered surface 197, and further rotation will cause pin 184 to cam upwardly and over into alignment with long, substantially vertical portion 198 of J-slot 180. Long portion 198 has a pair of upwardly facing chamfered surfaces 199. Once pin 184 is aligned with upwardly opening, long portion 197 of J-slot 180, it will be seen that upward movement of the tool string will disengage overshot 152 from inner mandrel 142, thus leaving packer assembly 10 in position in the well bore.

RETRIEVAL OF THE APPARATUS

Packer assembly 10 and inner mandrel 142 attached thereto may be easily retrieved from the well bore. Lowering overshot 152 on the lower end of the tool string will cause pin 184 thereon to engage surface 200 of inner mandrel 142. Pin 184 is then easily aligned with upwardly opening, long portion 197 of J-slot 180 and guided thereinto by chamfered surfaces 199, so that overshot 152 may be downwardly moved. As overshot 152 is downwardly moved, pin 184 thereon reengages tapered surface 197 of J-slot 180 which causes the pin to cam over into alignment with short portion 190 of the J-slot. Upward movement of the tool string and of overshot 152 thus results in pin 184 reengaging upper surface 188 of short portion 190 of J-slot 180.

Further upward motion of the tool string and overshot 152 results in longitudinally upward movement of inner mandrel 142 of releasing mechanism 12 and mandrel 30 of packer assembly 10. As mandrel 30 is upwardly moved, second shoulder 126 thereof reengages second shoulder 134 of slip retainer 70. Further upward movement of mandrel 30 will then result in slip 72 being pulled off of wedge 66 of upper packer support 62. Slip retaining springs 94 will then be free to inwardly bias slips 72 toward mandrel 30.

Lowermost surfaces 201, 202 and 204 of slots 82, 84 and 86, respectively, of slip retainer 70 engage flanges 90 of slips 74, 76 and 78, respectively, to upwardly pull on the slips. A study of FIG. 1C will show that lowermost surfaces 201, 202 and 204 are staggered with respect to lower end 206 of slip retainer 70, and are not equally spaced therefrom. The result is that lowermost surfaces 201, 202 and 204 engage and upwardly pull on slips 74, 76 and 78 sequentially, so that the slips are pulled off of wedge 66 one at a time. In other words, lowermost surface 201 pulls on slip 74 prior to lowermost surface 202 pulling on slip 76, and lowermost portion 202 pulls on slip 76 prior to lowermost surface 204 pulling on slip 78. This reduces the amount of force necessary to disengage slips 72 from the well bore.

As slip 78 (the last slip) is moved away from wedge 66 of upper packer support 62, packer element 60 is released because third shoulder 129 of mandrel 30 has already been disengaged from shoulder 138 of upper packer support 62. The resilience of packer element 60 will force upper packer support 62 upwardly, so that the packer element is disengaged from its sealing contact with the well bore.

Once slips 72 are unset and packer element 60 is unset, further lifting of the tool string will result in sealing nipple 25 being disengaged form liner screen 194. After this disengagement, the tool string, including release mechanism 12 and packer assembly 10 attached thereto, may be removed from the well.

It will be seen by those skilled in the art that the packer configuration shown in the present invention may also be adapted for use in a production string as a production packer where the production string below packer 10 is rigidly located in the well bore. In such a case, releasing mechanism 12 is not necessary. However, setting of slips 72 and packer element 60 are substantially identical to the method described above, in that downward motion of mandrel 30 is all that is necessary, and upward motion of the mandrel is all that is required to unset packer assembly 10. No rotation or pressurization are required.

It can be seen, therefore, that the screen liner tieback packer of the present invention is well adapted to carry out the ends and advantages mentioned, as well as those inherent therein. While a presently preferred embodiment of the apparatus, of a releasing mechanism for positioning the apparatus in a well bore, and of a method of use have been shown for the purposes of this disclosure, numerous changes in the construction and arrangement of the parts can be made by those skilled in the art. All such changes are encompassed within the scope and spirit of this invention as defined by the appended claims.

What is claimed is:

1. A downhole tool for use in a well bore, said tool comprising:

a packer assembly comprising:

a body;

a mandrel disposed in said body and having:

a first, downwardly facing shoulder;

a second, upwardly facing shoulder;

a third, downwardly facing shoulder; and a fourth, upwardly facing shoulder;

a lower packer support on said body and shearably attached to said mandrel, said lower packer support having a downwardly facing shoulder thereon engageable with said mandrel fourth shoulder;

an upper packer support, spaced from said lower packer support and shearably attached to said mandrel, said upper packer support having an upwardly facing shoulder thereon and further having a wedge portion;

a deformable packer element disposed between said upper and lower packer supports;

a plurality of slips adjacent said wedge portion of said upper packer support and angularly spaced around said mandrel;

a slip retainer engaged with said slips for positioning thereof and having a first upwardly facing shoulder thereon, said slip retainer further having a second downwardly facing shoulder thereon engaged with said mandrel second shoulder when said slips are in an unset position; and a spring disposed between said first shoulder of said mandrel and said first shoulder of said slip retainer;

whereby, said mandrel is movable longitudinally downwardly during a setting operation such that:

said mandrel first shoulder downwardly moves said spring, and thereby said slip retainer and said slips, forcing said slips into engagement with said wedge portion for outwardly directing said slips into gripping engagement with said well bore, said spring limiting downward force on said slips;

said mandrel second and fourth shoulders are moved away from said slip retainer second shoulder and said lower packer support shoulder, respectively; and said mandrel third shoulder engages said upper packer support shoulder, downwardly moving said upper packer support with respect to said lower packer support and deforming said packer element into sealing engagement with said well bore; and said mandrel is movable longitudinally upwardly during an unsetting operation, such that:

said mandrel third shoulder is moved away from said upper packer support thus releasing said packer element;

said mandrel second shoulder engages said slip retainer second shoulder, forcing said slip retainer upwardly, and thereby pulling said slips out of engagement with said well bore; and said mandrel fourth shoulder engages said lower packer support shoulder, preventing further upward movement of said mandrel with respect to said body.

2. The apparatus of claim 1 further comprising rotation prevention means for preventing relative rotation of said mandrel with respect to said slip retainer.

3. The tool of claim 1 further comprising a releasing mechanism comprising:

an overshot adapted for attachment to a tool string;

an inner mandrel disposed in said overshot and attached to said mandrel of said packer assembly; and J-slot means between said overshot and said inner mandrel for alternately providing engagement and disengagement of said overshot and said inner mandrel, and thereby alternately interconnecting said packer assembly to said tools tring and releasing said packer assembly from said tool string.

4. The appartus of claim 1 further comprising sequential slip release means for sequentially pulling said slips out of engagement with said well bore during said unsetting operation.

5. The apparatus of claim 1 further comprising seal means between said body and said mandrel for sealing therebetween.

6. The apparatus of claim 5 further comprising port means for equalizing pressure between said seal means and said well bore.

7. The apparatus of claim 2 wherein said gripping engagement of said slips with said well bore is increased if well pressure is increased below said packer element after said setting operation.

8. A method of packing a well annulus above a gravel packed liner screen in a well bore, said method comprising the steps of:

attaching a tieback packer to a tool string;

positioning said tool string and tieback packer in said well bore such that said tieback packer is in sealing engagement with said liner screen and downward movement of said tieback packer is limited by said liner screen when so engaged;

setting slip means on said tieback packer for limiting upward movement of said tieback packer while limiting the setting force thereon;

setting packer element on said tieback packer for sealing said well bore above said liner screen, both by longitudinally downwardly moving a mandrel in said tieback packer while preventing rotation of said mandrel; and releasing said tieback packer from said tool string.

9. The method of claim 8 further comprising a step of retrieving said tieback packer from said well bore, said retrieving comprising:

reengaging said tool string with said tieback packer;

unsetting said packer element and said slip means by longitudinally upwardly mvoing said mandrel and preventing rotation thereof;

disengaging said tieback packer from said liner screen; and removing said tool string and said tieback packer engaged therewith from said well bore.

10. The method of claim 9 wherein said step of unsetting said slip means comprises sequentially disengaging a plurality of slip elements from said well bore.

* * * * *

UNITED STATES PATENT AND TRADEMARK OFFICE

CERTIFICATE OF CORRECTION

PATENT NO. : 4,662,453

DATED : May 5, 1987

INVENTOR(S) : David P. Brisco

It is certified that error appears in the above-identified patent and that said Letters Patent is hereby corrected as shown below:

In column 2, line 44, delete "mean" and insert --means-- therefor.

In column 2, line 44, delete "sfor" and insert --for-- therefor.

In column 2, line 45, delete "packing" and insert --packer-- therefor.

In column 4, line 49, delete "are" and insert --has-- therefor.

In column 7, after line 1 insert --upper packer support 62 is free from mandrel 30, and wedge-- therefor.

In column 7, line 68, delete "129" and insert --128-- therefor.

In column 10, line 1, delete "tools" and insert --tool-- therefor.

In column 10, line 1, delete "tring" and insert -- string-- therefor.

In column 10, line 40, delete "mvoing" and insert --moving-- therefor.

Signed and Sealed this

Fifteenth Day of September, 1987

*Attest:*

DONALD J. QUIGG

*Attesting Officer* *Commissioner of Patents and Trademarks*